United States Patent [19]

Hall

[11] Patent Number: 4,959,640

[45] Date of Patent: Sep. 25, 1990

[54] APPARATUS FOR DETECT MISSING BATTERY IN SMOKE DETECTOR

[75] Inventor: Thomas L. Hall, Port Richey, Fla.

[73] Assignee: Pioneer Manufacturing, Inc., Holiday, Fla.

[21] Appl. No.: 320,946

[22] Filed: Mar. 9, 1989

[51] Int. Cl.[5] ..... G08B 23/00

[52] U.S. Cl. ..... 340/693; 340/628

[58] Field of Search ..... 340/693, 628–630

[56] References Cited

U.S. PATENT DOCUMENTS

| | | | |
|---|---|---|---|
| 4,228,428 | 10/1980 | Niedermeyer | 340/628 |
| 4,870,395 | 9/1989 | Belano | 340/693 |
| 4,881,063 | 11/1989 | Fawcett | 340/693 |

*Primary Examiner*—Donnie L. Crosland
*Assistant Examiner*—Thomas J. Mullen, Jr.
*Attorney, Agent, or Firm*—Jones, Day, Reavis & Pogue

[57] ABSTRACT

A battery-powered smoke detector in which the battery is inserted in a removable door that is then inserted into the detector to power the detector is rendered incapable of insertion into the smoke detector unless a battery is in place in the removable door. A spring-loaded door stop is moved by the spring into a position where it prevents the door from being inserted into the smoke detector. A pin in the female terminal of the door that engages the male terminal of the battery is forced away from the door stop by a spring. When the door stop is depressed manually and a battery is inserted into the terminals, the pin is forced by the male terminal of the battery into a latching position in the door stop, holding it in a position where it will not interfere with insertion of the door. The absence of a door provides warning to an observer that the battery-powered smoke detector is not operable for lack of a battery.

4 Claims, 2 Drawing Sheets

APPARATUS FOR DETECT MISSING BATTERY IN SMOKE DETECTOR

BACKGROUND OF THE INVENTION

This invention is related to smoke detectors. In particular, it is a device to prevent the insertion of a battery door in a smoke detector unless the battery door is equipped with a battery.

Smoke detectors have become accepted as primary means of warning for people in living spaces that are threatened by fire. Battery-powered smoke detectors are of particular utility in providing protection for residential spaces, mobile homes, motor homes, and hotel and motel rooms. Electrical codes are increasingly being amended to require smoke detectors in such locations.

The warning offered by a battery-powered smoke detector, however, is illusory if the smoke detector lacks a battery. Perhaps the most likely reason for a smoke detector to lack a battery is removal of the battery to prevent the smoke detector from sounding its alarm in a location near a kitchen, where the smoke detector may be affected by smoke or other combustion products from cooking. Occasional smoke from a fireplace may trigger a smoke detector that is located near the fireplace. Sometimes a smoke detector may be triggered by high humidity. All too often the reaction of a householder to a smoke detector that sounds an alarm in response to one of the conditions described above is to remove the battery to silence the detector. If the detector is then put back into apparent operating condition without the battery, it is no longer capable of giving a warning in case of a real fire.

One solution to the problem of smoke detectors that provide alarm signals in response to burning toast or smoky fireplaces is given in U.S. Pat. application Ser. No. 892,668 and U.S. Pat. No. Design 297,316, both of which are incorporated by reference as if set forth fully here. The smoke detector in the '668 application includes a silence feature, which reduces the sensitivity of the detector for a period of a few minutes after the detector is activated so as to give the unwanted smoke time to clear. In the smoke detector of the '668 application, the smoke detector continues to be functional with a sensitivity that is reduced initially and that increases over a period of four to ten minutes until the original sensitivity is restored. If the smoke condition continues when the sensitivity of the detector returns to a level at which the detector will sound an alarm, the patience of the householder may be stretched to the point of causing battery removal to stop the noise once and for all.

Another reason for battery removal occurs when people see the smoke detector as a source of a battery that they need for another appliance. Such perceived needs have led to the removal of batteries from many smoke detectors, rendering them inoperative when they are needed.

The threat of battery removal has led to the issuance of a standard by Underwriters'Laboratories to provide either a warning or a preventive. The warning would display a flag or a sign so that an observer could tell that a battery had been removed from the detector. The preventive would interfere with closure or reassembly of the smoke detector if the battery had been removed.

Most battery-powered smoke detectors require some disassembly of the detector to get at the battery for changing. In contrast, the smoke detector of U.S. Pat. application Ser. No. 892,668 includes a removable battery door into which a battery is snapped. Contacts from the battery terminals are connected to terminals in the smoke detector to supply battery power to operate the detector. However, in the invention as disclosed in the '668 Application, there is no way to tell from the outside of the detector whether or not a battery is installed in the removable door.

SUMMARY OF THE INVENTION

It is an object of the present invention to provide an indication of a missing battery in a battery-powered smoke detector.

It is a further object of the present invention to make it impossible to insert a battery-holding door into a battery powered smoke detector unless a battery is in place in the door.

Other objects will become apparent in the course of a detailed description of the invention.

A battery-powered smoke detector in which the battery is inserted in a removable door that is then inserted into the detector is rendered incapable of insertion into the smoke detector unless a battery is in place in the removable door. A spring-loaded door stop is moved by the spring into a position where it prevents the door from being inserted into the smoke detector. A pin in the female terminal of the door that engages the male terminal of the battery is forced away from the door stop by a spring. When the door stop is depressed manually and a battery is inserted into the terminals, the pin is forced by the male terminal of the battery into a latching position in the door stop, holding it in a position where it will not interfere with insertion of the door. The absence of a door provides warning to an observer that the battery-powered smoke detector is not operable for lack of a battery.

DETAILED DESCRIPTION OF THE INVENTION

Figure 1:
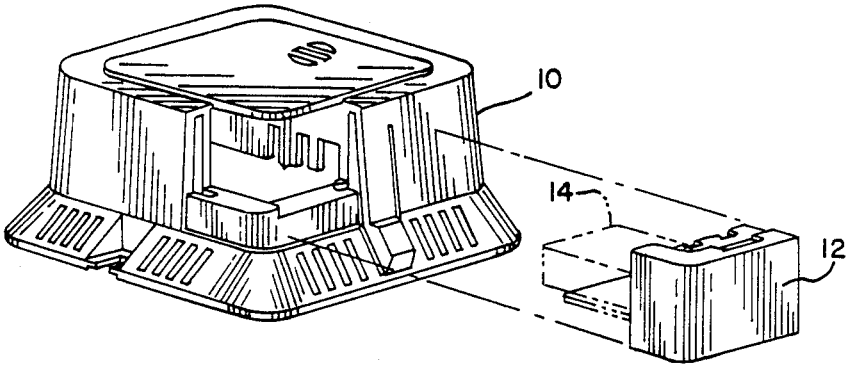
FIG. 1 is an exploded isometric view of a smoke detector and a battery door when the door is removed.

FIG. 1 is an isometric view of a smoke detector with a door for the Practice of the present invention. In FIG. 1, a smoke detector 10 is shown with a door 12 that has been removed from the smoke detector 10 and that is aligned for insertion into the smoke detector 10. A battery 14 is shown in phantom view. The smoke detector 10 of FIG. 1 was disclosed in U.S. Pat. No. Des. 297,316 and in U.S. patent application Ser. No. 892,668, both of which are assigned to the assignee of the present invention.

Figure 2:
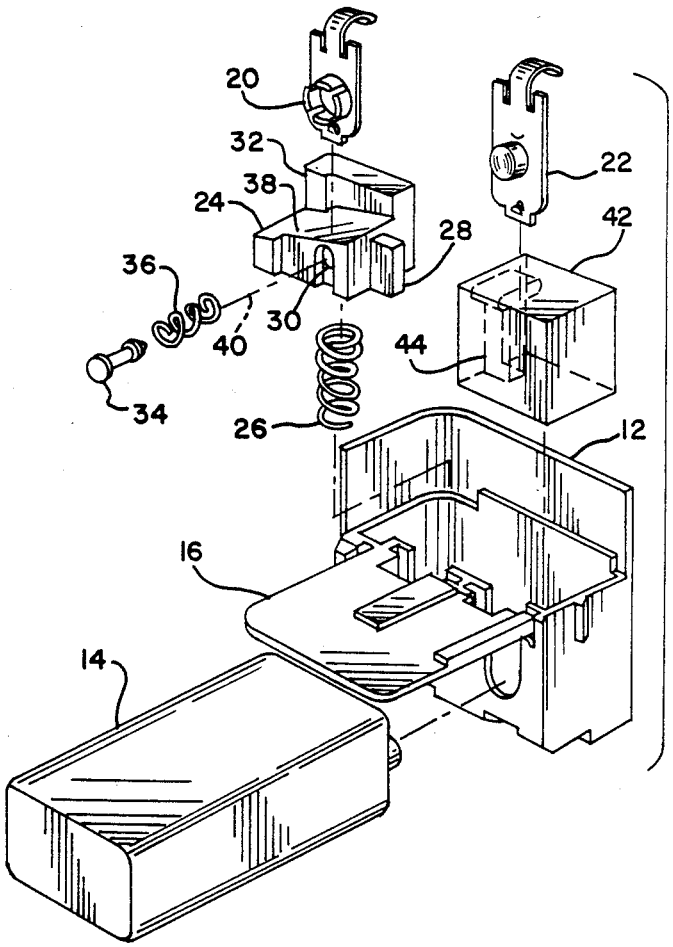
FIG. 2 is an exploded isometric view of the battery door of Fig. 1.

FIG. 2 is an exploded perspective view showing the components of an apparatus for the practice of the present invention. In FIG. 2, the door 12 includes a shelf 16 that assists in the insertion of a battery 14 into engagement with a female terminal 20 and a male terminal 22. The terminals 20 and 22 are shown in their exploded position in FIG. 2. When the exploded view is assembled the terminals 20 and 22 will be placed down and into engagement with the door 12.

A stop 24 is forced away from the door 12 by a spring 26, which is shown here as a coil spring, but could equally as well be any other type of spring that would maintain a force to separate the stop 24 from the door 12. The stop 24 includes a tang 28, a pin hole 30, and a projection 32. The tang 28 is a retainer that will be seen to hold the stop 24 in place while permitting it to slide. The pin hole 30 engages a pin 34 that is inserted through the female terminal 20. A spring 36 maintains a force between the pin 34 and the terminal 20 to force the pin 34 away from the terminal 20 in the absence of a condition that would compress the spring 36. A surface 38 of the stop 24 is seen in FIG. 2 to be beveled with respect to the upper and lower surfaces of the stop 24. This is a matter of design choice. In the apparatus that has been built for the practice of the present invention, the motion of the stop 24 that will be described later permitted rotation about the axis 40 of the pin 34 when the stop 24 was translated vertically so that the surface 38 was substantially parallel to the top and bottom of the door 12 when the stop 24 was in the up position.

FIG. 2 also includes a spacer 42 that was wedged into the door 12 to guide motion of the stop 24. It should be evident that the function of the spacer 42 could equally as well be served by molding a guiding spacer into the door 12. This is a matter of design choice. The spacer 42 also shows a slot 44 that engages the tang 28 of the stop 24 to permit sliding motion of the stop 24 with respect to the spacer 42. In FIG. 2, the slot 44 appears to have a T-shape. This was done to provide square corners at the top of the slot 44. The T-shape is therefore one way of obtaining such corners, but the T-shape is not necessary for the practice of the present invention.

Figure 3:
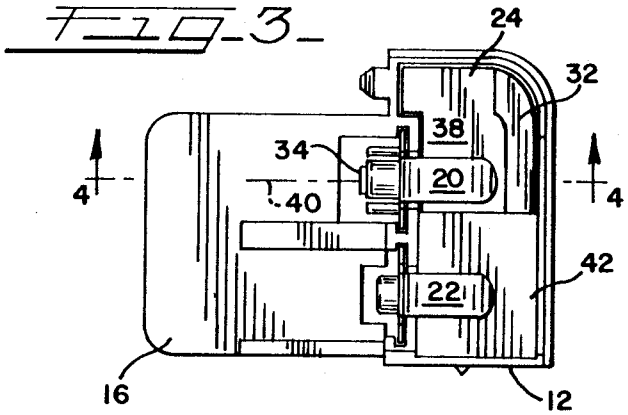
FIG. 3 is a top view of the battery door without a battery in place.
Figure 4:
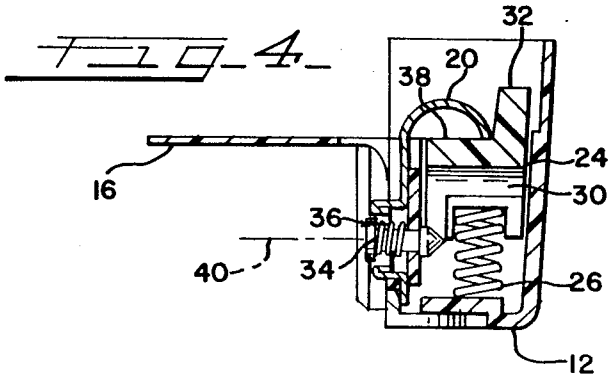
Fig. 4 is a sectional side view of the battery door of FIG. 3 taken along section lines 4—4.

FIG. 3 is a top view of a door 12 that is equipped for the practice of the present invention, and FIG. 4 is a section side view of the door 12 of FIG. 3, taken along section lines 4—4. In FIGS. 3 and 4, there is no battery in place. If there were, it would be connected to the door 12 at the female terminal 20 and the male terminal 22, and would project beyond the shelf 16. The spring 36 is seen in FIG. 4 to be expanded, causing the pin 34 to project beyond the end of the female terminal 20. The hole 30 in the stop 24 is not aligned with the axis 40 of the pin 34. As a result, the spring 26 is expanded, and the stop 24 is allowed to raise, raising the projection 32. Referring to FIG. 1, the raised projection 32 will strike the smoke detector 10 on any attempt to insert the door 12 into the smoke detector 10. This makes it impossible to insert the door 12 into the smoke detector 10 when its components are arranged as they are in FIGS. 3 and 4.

Figure 5:
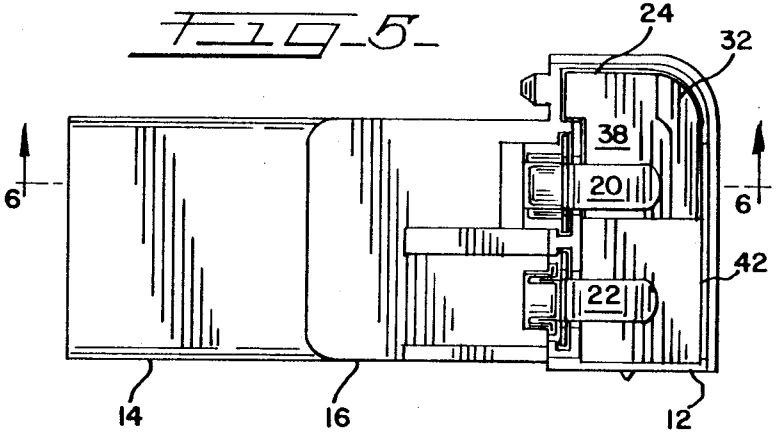
FIG. 5 is a top view of the battery door with a battery in place.
Figure 6:
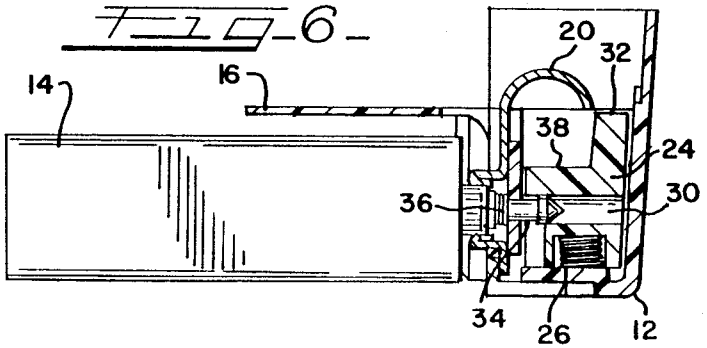
FIG. 6 is a sectional side view of the battery door of FIG. 5 taken along section lines 6—6.

FIG. 5 is a top view of the door 12 with the battery in place and FIG. 6 is a sectional side view of the door 12 of FIG. 5, taken along section lines 6—6. In FIGS. 5 and 6, a battery 14 has been inserted so as to engage the terminals 20 and 22 of the door 12. In order to insert the battery 14, it was first necessary to depress the stop 24, compressing the spring 26, until the hole 30 was aligned with the axis 40 of the pin 34. This allowed insertion of the battery 14 to press the pin 34 into the hole 30 so that the pin 34 and the hole 30 were coaxial, thus holding the stop 24 so that the projection 32 was below the level of the shelf 16. This permitted insertion of the door 12 containing a battery 14 into the smoke detector 10 of FIG. 1. In FIGS. 3, 4, 5, and 6, the spacer 42 holds the stop 24 in place and guides it by permitting motion of the tang 28 of FIG. 2 in the slot 44 of FIG. 2. Neither the tang 28 nor the slot 44 is visible in FIGS. 3, 4, 5, and 6.

In an apparatus that was built for the practice of the present invention, the stop 24, the pin 34, and the spacer 42 were all made of polypropylene. Any or all of them could equally as well be made of nylon, high-density polyethylene, or any engineering plastic or solid material that does not interfere with sliding motion between the particular part and the door 12. The pin 34 must be capable of withstanding forced insertion through a hole in the door 12 without being damaged.

The views of FIGS. 4 and 6 indicate that the spring 26 was perpendicular to and intersected the axis 40 of the pin 34. This is shown for convenience of drawing. In the apparatus as built and tested, the axis of the spring 26 was moved toward the top of FIGS. 3 and 5 so as to clear the hole 30. This caused the rotation of the stop 24 about the axis 40 when the stop 24 was allowed to achieve the position shown in FIG. 4. This also is a matter of design choice. It was also convenient to assemble the apparatus of FIGS. 3–6 by having a spacer 42 that was removable and that could be inserted with the stop 24. The stop 42 could equally as well have been molded into the door 12. Similarly, rather than have a tang 28, as shown in FIG. 2, in the stop 24 to engage a slot 44 in the spacer 42, it would have been equally possible to put a tang in the stop 42 and a slot in the stop 24. The function of the invention that is achieved in these variations is a stop 24 that rises to prevent insertion of door 12 into the smoke a detector 10 unless the stop 24 has been depressed so that it can be held in place by the pin 34 which is moved into engagement by a positive terminal of the battery 14 when the battery 14 is inserted in place.

The description given here of the invention is illustrative, and is not intended to be limiting. The scope of the invention should be limited only as claimed in the appended claims.

I claim:

1. An apparatus for providing visible indication of absence of a battery from a battery-powered smoke detector having an insertable door that holds a battery, the apparatus comprising:

a. a stop;

b. a stop spring disposed to engage the stop so as to exert a force that maintains the stop in a position that prevents insertion of the door into the smoke detector c. means for latching a stop into a position that permits insertion of the door into the smoke detector; and d. means for operating the means for latching upon insertion of a battery into a pair of terminals in the door.

2. The apparatus of claim 1 wherein the means for latching comprises:

(a) a pin that projects through a female terminal in a first position and that engages the spring-loaded stop so as to latch the stop in a second position that compresses the stop spring and maintains the stop in a position that permits insertion of the door into the smoke detector; and (b) a pin spring that is disposed to apply a force causing the pin to project through the female terminal and thus assume the first position an d that is compressed when the pin is caused to assume the second position to latch the stop.

3. The apparatus of claim 2 wherein the means for operating the means for latching comprises a male terminal of a battery that engages the pin to move the pin from the first position to the second position that latches the stop and permits insertion of the door when the battery is inserted into the female terminal.

4. In a smoke detector having a removable door that supports the battery and a set of male and female terminals affixed to the door, supporting the battery, and connecting the battery to the smoke detector to power the smoke detector, the improvement comprising:

(a) a spacer affixed to the door and including a guide slot;

(b) a sop having a tang insertable in the guide slot and movable with respect to the spacer so that the tang slides in the guide slot, the stop also including an aperture and a projection capable of preventing insertion of the door into the smoke detector in a first position and permitting insertion of the door in a second position;

(c) a spring disposed to maintain a spring force between the stop and the door to hold the stop in the first position if a battery is not connected to the terminals;

(d) a pin having an axis that is coaxial with an axis of the female terminal and movable on the axis so as to be free of the aperture in the stop in a first pin position and to engage the aperture in the stop in a second pin position, the pin projecting from the female terminal in the first position such that insertion of the battery into the battery terminals when the stop is moved to place the axis of the aperture into alignment with the axis of the pin presser the pin into the aperture to hold the stop in the second position and thereby permit insertion of the door into the smoke detector.

* * * * *